US008967996B2

(12) United States Patent
Tanoura et al.

(10) Patent No.: US 8,967,996 B2
(45) Date of Patent: Mar. 3, 2015

(54) COMBUSTION CONTROLLER

(75) Inventors: Masazumi Tanoura, Tokyo (JP); Kenji Muta, Tokyo (JP); Shinichiro Asami, Tokyo (JP); Eiji Kato, Tokyo (JP); Tadashi Aoki, Tokyo (JP); Koutaro Fujimura, Tokyo (JP); Tetsuya Sawatsubashi, Tokyo (JP); Chisato Tsukahara, Tokyo (JP); Shinsaku Dobashi, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 641 days.

(21) Appl. No.: 13/321,913

(22) PCT Filed: Feb. 19, 2010

(86) PCT No.: PCT/JP2010/052562

§ 371 (c)(1),
(2), (4) Date: Nov. 22, 2011

(87) PCT Pub. No.: WO2011/040053

PCT Pub. Date: Apr. 7, 2011

(65) Prior Publication Data

US 2012/0079969 A1 Apr. 5, 2012

(30) Foreign Application Priority Data

Sep. 29, 2009 (JP) ..... 2009-225086

(51) Int. Cl.
*F23L 9/04* (2006.01)
*F22B 21/40* (2006.01)

(Continued)

(52) U.S. Cl.
CPC . *F23L 9/04* (2013.01); *F22B 21/40* (2013.01); *F22B 37/025* (2013.01); *F23C 5/32* (2013.01);

(Continued)

(58) Field of Classification Search
CPC ..... F23N 3/00; F23N 5/00; F23N 5/003; F23N 5/08; F23N 2900/05002
USPC ..... 431/75, 76, 79; 110/188
See application file for complete search history.

(56) References Cited

U.S. PATENT DOCUMENTS 4,929,561 A 5/1990 Hirschfeld
5,702,678 A * 12/1997 Cieutat et al. ..... 423/567.1

(Continued)

FOREIGN PATENT DOCUMENTS

CN 1938621 A 3/2007
DE 102006022657 A1 11/2007

(Continued)

OTHER PUBLICATIONS

International Search Report of PCT/JP2010/052562, mailing date Mar. 23, 2010.

(Continued)

*Primary Examiner* — Avinash Savani
(74) *Attorney, Agent, or Firm* — Westerman, Hattori, Daniels & Adrian, LLP

(57) ABSTRACT

The combustion controller controls the fuel and air that are supplied to the combustion furnace for burning substances, and addresses the aforementioned object by including: fuel supply unit for supplying fuel and air into the combustion furnace; air supply unit for supplying air into the combustion furnace, the air supply unit being disposed downstream of the fuel supply unit in the direction of flow of combustion air; concentration measuring unit for measuring the concentration of hydrogen sulfide of the combustion air by passing a measurement beam of light through the combustion air at a measurement position downstream of the fuel supply unit in the direction of flow of the combustion air; and control unit for controlling the amount of air supplied from the fuel supply unit based on a measurement result provided by the concentration measuring unit.

9 Claims, 10 Drawing Sheets

(51) Int. Cl.

| | |
|---|---|
| ***F22B 37/02*** | (2006.01) |
| ***F23C 5/32*** | (2006.01) |
| ***F23N 3/00*** | (2006.01) |
| ***F23N 5/00*** | (2006.01) |
| ***F23N 5/08*** | (2006.01) |

(52) U.S. Cl.

CPC ..... *F23N 3/002* (2013.01); *F23N 5/003* (2013.01); *F23N 5/082* (2013.01); *F23C 2201/101* (2013.01); *F23N 2021/10* (2013.01); *F23N 2041/10* (2013.01)

USPC ..... 431/75; 431/76; 431/79; 110/188

(56) References Cited

U.S. PATENT DOCUMENTS

| | | | | |
|---|---|---|---|---|
| 5,936,250 | A * | 8/1999 | Baliga et al. | 250/373 |
| 6,907,757 | B2 | 6/2005 | Kuwahara et al. | |
| 7,952,064 | B2 * | 5/2011 | Haffner | 250/227.11 |
| 8,109,759 | B2 * | 2/2012 | Robertson et al. | 431/18 |
| 2002/0115030 | A1 * | 8/2002 | Koegl et al. | 431/76 |
| 2002/0117401 | A1 | 8/2002 | Breen et al. | |
| 2003/0108831 | A1 * | 6/2003 | Harada et al. | 431/2 |
| 2006/0124852 | A1 | 6/2006 | Von Drasek | |
| 2008/0076080 | A1 * | 3/2008 | Hu et al. | 431/9 |
| 2008/0083229 | A1 * | 4/2008 | Haynes et al. | 60/776 |

FOREIGN PATENT DOCUMENTS

| | | | |
|---|---|---|---|
| JP | 62-035246 | A | 2/1987 |
| JP | 62-192044 | U | 12/1987 |
| JP | 63-183315 | A | 7/1988 |
| JP | 6-102181 | A | 4/1994 |
| JP | 2000-249334 | A | 9/2000 |
| JP | 2002-139409 | A | 5/2002 |
| JP | 2006-520458 | A | 9/2006 |
| JP | 2007-263505 | A | 10/2007 |

OTHER PUBLICATIONS

Written Opinion of PCT/JP2010/052562, mailing date Mar. 23, 2010.

Japanese Decision to Grant a Patent dated Dec. 10, 2013, issued in Japanese Patent Application No. 2009-225086, w/English transation, (3 pages).

Chinese Office Action dated Jul. 21, 2014, issued in corresponding Chinese Patent Application No. 201080023579.3, w/English translation (25 pages).

Extended European Search Report dated Nov. 17, 2014, issued in corresponding European Application No. 10820174.0. (5 pages).

Chinese Notification on the Grant of Patent Right for Invention dated Nov. 6, 2014, issued in corresponding Chinese Application No. 201080023579.3; w/English Translation. (2 pages).

Chinese Notification for Patent Registration Formalities dated Nov. 6, 2014, issued in corresponding Chinese Application No. 201080023579.3; w/English Translation. (2 pages).

* cited by examiner

COMBUSTION CONTROLLER

FIELD

The present invention relates to a combustion controller for controlling the combustion state of combustion apparatus such as boilers by adjusting the amounts of fuel and air that are supplied thereto.

BACKGROUND

Various types of combustion apparatus have been available for burning substances in a combustion furnace, such as boilers for burning fuel or refuse incinerators for burning garbage. For example, disclosed in Patent Literature 1 is a coal-fired boiler in which powdered coal is supplied to a combustion furnace along with air to burn the powdered coal within the combustion furnace, allowing the heat generated by combustion to heat a boiler tube and thereby generate steam within the boiler tube.

CITATION LIST

Patent Literature

Patent Literature 1: Japanese Patent Application Laid-Open No. 2007-263505

SUMMARY

Technical Problem

As can be seen from above, combustion apparatus for combustion within the combustion furnace cause nitrogen oxide to be generated during combustion. Available as a method for suppressing the generation of nitrogen oxide during combustion is one for creating a reduction atmosphere, that is, an oxygen-lean atmosphere inside the combustion furnace. Creating such a reduction atmosphere makes it possible to suppress the generation of nitrogen oxide or an oxide.

However, the reduction atmosphere created in this manner within the incinerator may be excessively enhanced. In this case, sulfuric components contained in the substances to be burnt such as fuel or garbage can be reduced to hydrogen sulfide. Hydrogen sulfide produced within a combustion passage would corrode some members inside the incinerator, for example, boiler tubes for absorbing heat inside the incinerator.

The present invention was developed in view of the aforementioned problems. It is an object of the present invention to provide a combustion controller which can suppress the generation of nitrogen oxide while suppressing corrosion of each portion inside a combustion furnace.

Solution to Problem

According to an aspect of the present invention, a combustion controller for controlling fuel and air which are supplied into a combustion furnace for burning a substance, includes: a fuel supply unit for supplying fuel and air into the combustion furnace; an air supply unit which is disposed downstream of the fuel supply unit in a direction of flow of combustion air and supply air into the combustion furnace; a concentration measuring unit for measuring a concentration of hydrogen sulfide of the combustion air by passing a measurement beam of light through the combustion air at a measurement position downstream of the fuel supply unit in the direction of flow of the combustion air; and a control unit for controlling an amount of air to supply from the fuel supply unit based on a measurement result provided by the concentration measuring unit.

It is possible to measure the hydrogen sulfide concentration of the combustion air inside the combustion furnace, and adjust the amount of supplied air based on the measurement result, thereby suppressing the generation of hydrogen sulfide.

Advantageously, in the combustion controller, the control unit increases the amount of air to supply from the fuel supply unit when the concentration of hydrogen sulfide at the measurement position is higher than a preset upper limit, and reduces the amount of air to supply from the fuel supply unit when the concentration of hydrogen sulfide at the measurement position is less than a preset lower limit.

Providing control in this manner makes it possible to maintain the amount of generated hydrogen sulfide at a predetermined concentration or less, allowing a reduction atmosphere to be maintained as at an enhanced level.

Advantageously, in the combustion controller, the measurement beam of light is a laser beam in a wavelength band that is absorbed by the hydrogen sulfide, and the concentration measuring unit includes a light-emitting element for emitting a laser beam, a light-receiving element for receiving a laser beam having emitted from the light-emitting element and having passed through the combustion air, and a computing unit for computing the concentration of hydrogen sulfide based on the beam of light emitted from the light-emitting element and the beam of light received by the light-receiving element.

Use of the aforementioned measuring method makes it possible to measure the concentration accurately in a short period of time and thus provide control to the reduction atmosphere and the amount of generated hydrogen sulfide with improved accuracy.

Advantageously, in the combustion controller, the concentration measuring unit has a guide pipe for guiding air at the measurement position inside the combustion furnace, the light-emitting element irradiates combustion air flowing through the guide pipe with the laser beam, and the light-receiving element receives the laser beam having passed through the combustion air inside the guide pipe.

The provision of the guide pipe makes it possible to measure the concentration of the combustion air at a desired position. Furthermore, even when the combustion furnace has a large diameter, the concentration at the central position can be measured. Furthermore, the measuring unit can be prevented from being affected by heat.

Advantageously, the combustion controller further includes an oxygen concentration measuring unit for measuring a concentration of oxygen of the combustion air by passing a measurement beam of light through the combustion air at the measurement position. The control unit also takes into account a measurement result provided by the oxygen concentration measuring unit to control the amount of air to supply from the fuel supply unit and an amount of air to supply from the air supply unit.

Providing control by taking the oxygen concentration into account makes it possible to control the reduction atmosphere more adequately.

Advantageously, in the combustion controller, a plurality of the concentration measuring units for measuring concentrations are provided and measure a concentration of hydrogen sulfide at a plurality of measurement positions located at different positions in the direction of flow of the combustion air, and the control unit controls the amount of air to supply from the fuel supply unit and the amount of air to supply from the air supply unit so that a concentration of hydrogen sulfide in air inside the combustion furnace is gradually reduced with an increased distance from the fuel supply unit in the direction of flow of the combustion air.

Measuring the concentration at a plurality of positions allows the aforementioned control to be provided more adequately in a finer manner.

Advantageously, in the combustion controller, a plurality of the air supply units for supplying air into the combustion furnace are provided, and the control unit controls the amount of air to supply from the air supply unit so that the concentration of oxygen in the air inside the combustion furnace gradually increases with an increased distance from the fuel supply unit in the direction of flow of the combustion air.

Furthermore, providing an air supplying unit at a plurality of positions in the direction of flow of the combustion air makes it possible to supply an appropriate amount of air to the combustion air at each position. Furthermore, gradually increasing the oxygen concentration leads to gradual weakening of the reduction atmosphere, thus allowing combustion to take place in a preferred fashion while suppressing the generation of nitrogen oxide.

Advantageously, in the combustion controller, the measurement position is downstream of the fuel supply unit in the direction of flow of the combustion air and upstream of a reheater disposed inside the combustion furnace.

Specifying a measurement position to be upstream of the reheater makes it possible to keep a given amount of hydrogen sulfide or less arriving at the reheater. This further ensures that the reheater is prevented from being corroded.

Advantageously, the combustion controller further includes a nitrogen oxide concentration measuring unit for measuring a concentration of nitrogen oxide of the combustion air by passing a measurement beam of light through the combustion air at the measurement position. The control unit also takes into account a measurement result provided by the nitrogen oxide concentration measuring unit to control the amount of air to supply from the fuel supply unit and the amount of air to supply from the air supply unit.

Providing control according to the concentration of nitrogen oxide at a measurement position further ensures that the generation of nitrogen oxide is suppressed and the generation of hydrogen sulfide is suppressed as well.

Advantageously, in the combustion controller, when the measurement result provided by the nitrogen oxide concentration measuring unit is higher than a preset upper limit, the control unit increases the amount of air supplied from the fuel supply unit irrespective of the concentration of hydrogen sulfide.

Placing priority to control provided based on the concentration of nitrogen oxide allows nitrogen oxide to be generated with greater difficulty.

Advantageous Effects of Invention

The combustion controller according to the present invention adjusts the amount of supplied air according to the concentration of hydrogen sulfide in fuel and air, thereby providing effects of suppressing the generation of hydrogen sulfide while suppressing the generation of nitrogen oxide.

DESCRIPTION OF EMBODIMENTS

A combustion controller according to an embodiment of the present invention will now be described in more detail below with reference to the drawings. Note that the invention is not limited to the embodiments. Note that in the embodiments below, descriptions will be made to a case where the combustion controller is attached to a boiler which acquires as power the heat energy that is produced by burning powdered coal in a combustion furnace. However, the combustion apparatus to which the combustion controller is attached is not limited to the boiler but may also include various types of combustion apparatus such as pyrolysis furnaces, melting furnaces, boilers, or external combustion engines. Note that the combustion apparatus of the present invention include no internal combustion engines. Furthermore, the embodiments below employ powdered coal as fuel. However, various types of fuels may also be employed as long as the fuels contain a sulfuric component.

Figure 1:
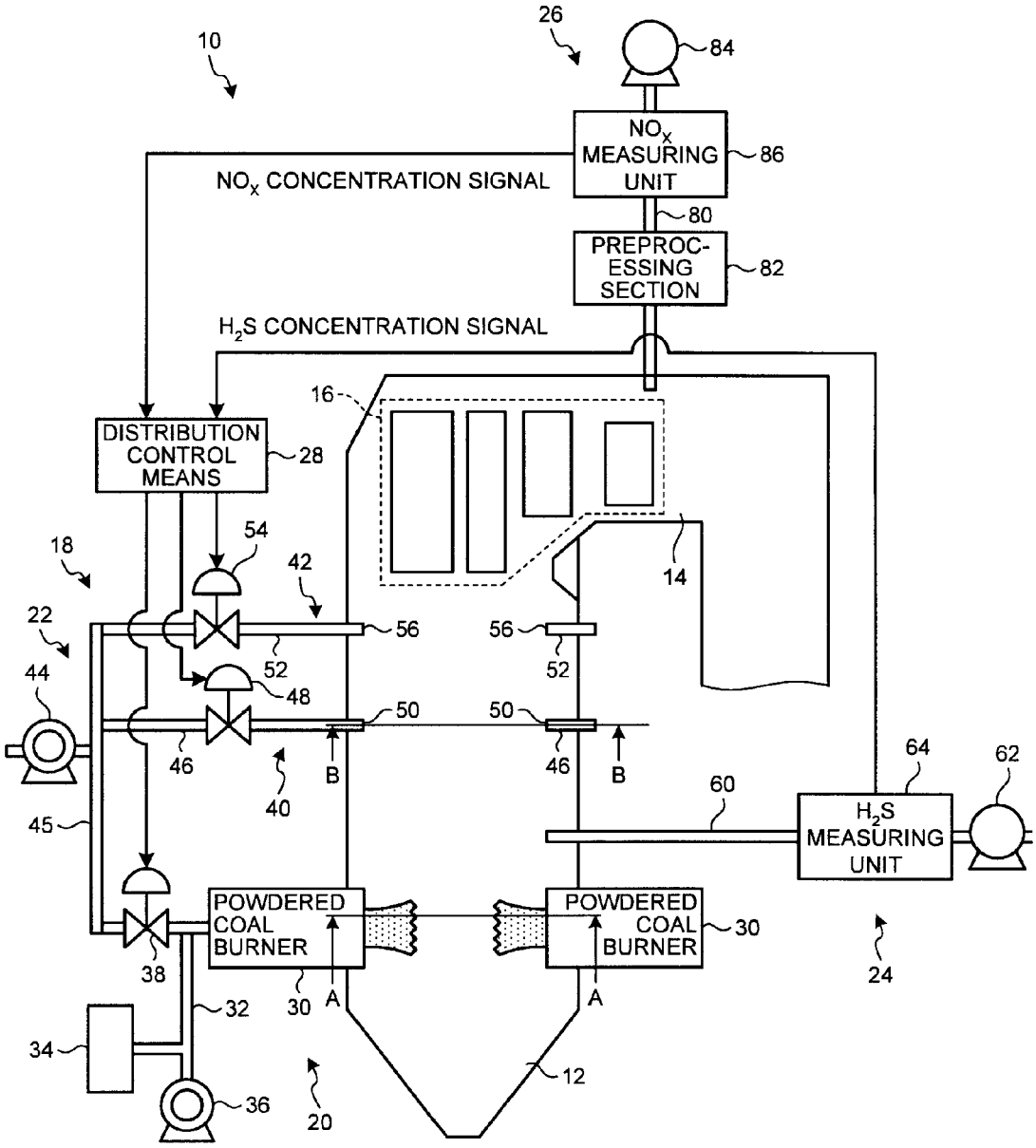
FIG. 1 is a block diagram illustrating a general configuration of a boiler of an embodiment which has a combustion controller of the present invention.

FIG. 1 is a block diagram illustrating a general configuration of a boiler of an embodiment which has the combustion controller of the present invention. As shown in FIG. 1, the boiler 10 has essentially a combustion furnace 12 for burning fuel; a flue 14 for guiding combustion air produced in the combustion furnace 12; a reheater unit 16 for acquiring heat energy from the combustion air; and the combustion controller 18 for supplying fuel and air into the combustion furnace 12 and controlling combustion within the combustion furnace 12.

The combustion furnace 12 serves to burn fuel and is a box-shaped member formed of a heat-resistant material. Furthermore, the combustion furnace 12 has a box-shaped surface (basically, the upper surface in the vertical direction) opened to connect to the flue 14. Note that in this embodiment, the combustion furnace 12 has a rectangular tube shape but can also have a cylindrical shape. Furthermore, the combustion furnace 12 has various types of pipes of the combustion controller 18, which are inserted from outside into the box-shaped furnace. The combustion furnace 12 burns in the box-shaped furnace the fuel that is supplied from the combustion controller 18.

The flue 14 is a pipe-shaped member coupled to one surface of the combustion furnace 12 and serves to guide the combustion air produced by burning fuel inside the combustion furnace 12 and the air that has been heated to a predetermined temperature.

The reheater unit 16 is composed of a plurality of reheaters and disposed in the travel route of the combustion air, more specifically, inside part of the combustion furnace 12 and the flue 14. The reheater, which is a pipe-shaped member, has a liquid or a gas sealed therein and acquires the heat energy from the combustion air by the inner liquid or gas absorbing the heat of the combustion air.

The combustion controller 18 supplies fuel and air into the combustion furnace 12 and allows the fuel to be burnt within the combustion furnace 12. The combustion controller 18 will be described in more detail later.

As described above, the boiler 10 is constructed to burn fuel within the combustion furnace 12 to produce heated combustion air. The combustion air moves from the combustion furnace 12 into the flue 14, during which the combustion air heats the reheater unit 16. The reheater unit 16 is superheated, e.g., to vaporize the inner liquid, whereby the liquid is expanded to steam. The steam travels from the reheater unit through a predetermined path to reach and turn a turbine, thereby allowing the heat energy to be turned into electrical or mechanical energy. The boiler 10, which is used in this manner, can be employed as an electrical generator or a driving machine. Furthermore, the heat energy acquired by the reheater unit 16 can be used to heat a given substance, thereby allowing the boiler to be used as a heating machine. Furthermore, the boiler may be configured without being limited to the configuration of this embodiment and may also be provided, for example, with various types of devices for cleaning the combustion air.

Figure 2A:
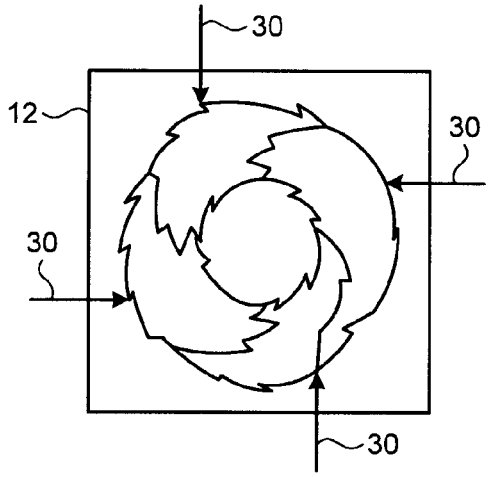
FIG. 2A is a cross-sectional view taken along line A-A of a combustion furnace shown in FIG. 1.
Figure 2B:
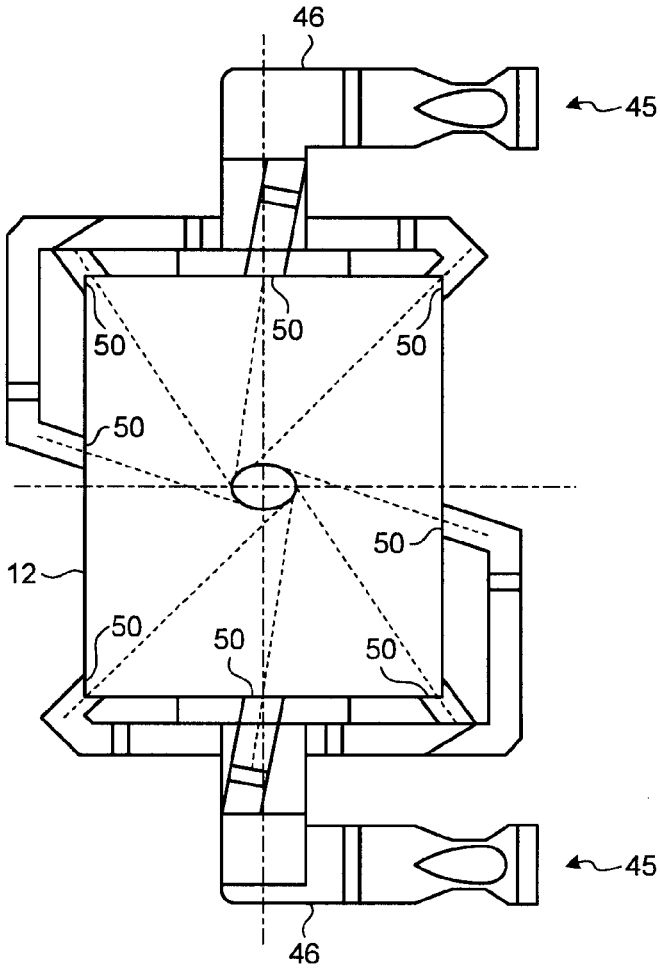
FIG. 2B is a cross-sectional view taken along line B-B of the combustion furnace shown in FIG. 1.
Figure 3:
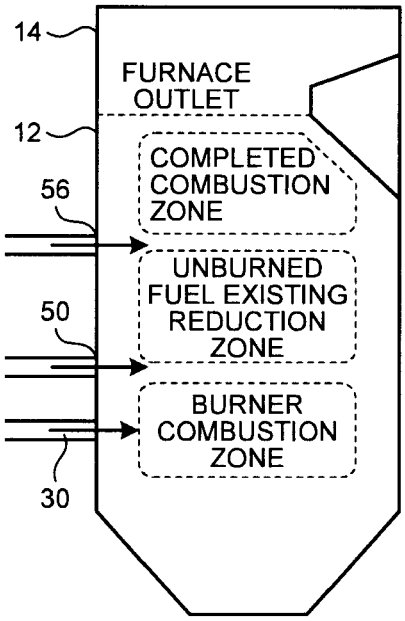
FIG. 3 is an explanatory view illustrating each zone of the combustion furnace shown in FIG. 1.

A description will next be made to the combustion controller 18. Here, FIG. 2A is a cross-sectional view taken along line A-A of the combustion furnace shown in FIG. 1, and FIG. 2B is a cross-sectional view taken along line B-B of the combustion furnace shown in FIG. 1. Furthermore, FIG. 3 is an explanatory view illustrating each zone of the combustion furnace shown in FIG. 1. As shown in FIG. 1, the combustion controller 18 has a fuel supply unit 20, an air supply unit 22, a concentration measuring unit 24, a nitrogen oxide concentration measuring unit 26, and a control unit 28.

The fuel supply unit 20 has powdered coal burners (hereinafter referred to as the "burner") 30, a pipe 32, a powdered coal supply section 34, a blower 36, and a flow regulating valve 38. The burner 30 is a combustor which is disposed on the combustion furnace 12 so as to expose the nozzle thereof inside the combustion furnace 12. The burner 30 is configured to inject through the nozzle the powdered coal and air to be supplied via the pipe 32, allowing the powdered coal to be burnt within the combustion furnace 12. Note that as shown in FIG. 2A, the burners 30 are provided at a plurality of positions of the combustion furnace 12. This embodiment employs the burners 30, which are four in total with one on each surface of the square wall surfaces. Furthermore, as shown in FIG. 2A, in the fuel supply unit 20, the burners 30 are disposed so that the air injected from each of the burners 30 forms a vortical air flow inside the combustion furnace 12. More specifically, when viewed from above downward in the vertical direction, the burners 30 are disposed so as to allow the air to flow in a counterclockwise direction around the center axis of the cross section of the combustion furnace 12.

The pipe 32 is a pipe-shaped member having a plurality of branches, which are connected to the plurality of burners 30, the powdered coal supply section 34, the blower 36, and the flow regulating valve 38. The pipe 32 supplies, to each burner 30, the powdered coal supplied from the powdered coal supply section 34, the air supplied from the blower 36, and the air supplied via the flow regulating valve 38.

The powdered coal supply section 34 is a mechanism for supplying powdered coal serving as fuel to the pipe 32. Note that the powdered coal supply section 34 may be either a mechanism for crushing coal into powdered coal and supplying the resulting powdered coal to the pipe 32 or a mechanism for storing prepared powdered coal and supplying the stored powdered coal to the pipe 32. The blower 36 produces air flow for transferring the powdered coal, which has been supplied from the powdered coal supply section 34 to the pipe 32, to a predetermined position in the pipe. The blower 36 is connected to the pipe 32 at a position upstream of the powdered coal supply section 34 in the direction of air flow. The blower 36 supplies air into the pipe 32, thereby transferring the powdered coal inside the pipe 32 by air.

The flow regulating valve 38 regulates the flow rate of air and is disposed at the connection between the pipe 32 and a main pipe 45 of the air supply unit 22, which is to be described later. The flow regulating valve 38 is directed by the control unit 28 to regulate the amount of air supplied from the main pipe 45 to the pipe 32.

The fuel supply unit 20 allows the blower 36 to transfer the powdered coal, which is supplied from the powdered coal supply section 34, to the burner 30 and feeds air to the burner 30 while the flow rate is being regulated by the flow regulating valve 38. The burner 30 thus injects the powdered coal and air into the combustion furnace 12, so that the injected powdered coal is burnt to produce combustion air (combustion gas). Note that the produced combustion air travels through a predetermined path inside the combustion furnace to the flue.

The air supply unit 22 has a first air supplying unit 40, a second air supplying unit 42, an air blower 44, and the main pipe 45 which couples between the first air supplying unit 40, the second air supplying unit 42, and the blower 44.

The first air supplying unit 40 has a first pipe 46 disposed to allow a blowoff outlet 50 to expose in the combustion furnace 12 and a flow regulating valve 48 which can regulate the amount of air. The first pipe 46 is coupled to the main pipe 45 via the flow regulating valve 48 to allow the air supplied from the main pipe 45 to be blown off through a plurality of blowoff outlets 50. Here, the blowoff outlet 50 is disposed so as to blow off air into the combustion furnace 12 at a position downstream of the fuel supply unit 20 in the travel route of the combustion air. Furthermore, as shown in FIG. 2B, the plurality of blowoff outlets 50 are disposed at predetermined intervals on the outer circumference of the combustion furnace 12. The flow regulating valve 48 is disposed at the connection between the main pipe 45 and the first pipe 46 to regulate the amount of air supplied from the main pipe 45 to the first pipe 46.

The second air supplying unit 42 has a second pipe 52 disposed for a blowoff outlet 56 to be exposed in the combustion furnace 12 and a flow regulating valve 54 which can regulate the amount of air. The second pipe 52 is coupled to the main pipe 45 via the flow regulating valve 54, allowing a plurality of blowoff outlets 56 to blow off the air supplied from the main pipe 45. Here, the blowoff outlet 56 is disposed so as to blow off air into the combustion furnace 12 at a position downstream of the blowoff outlets 50 in the travel route of the combustion air. Furthermore, the blowoff outlet 56 is basically identical in configuration to the blowoff outlet 50 only except that the outlets are located at different positions in the travel route of the combustion air. The flow regulating valve 54 is disposed at the connection between the main pipe 45 and the second pipe 52 so as to regulate the amount of air supplied from the main pipe 45 to the second pipe 52.

The blower 44, which is a blower, a fan or the like for feeding air, feeds air to the main pipe 45. Note that the amount and the flow speed of air fed from the blower 44 to the main pipe 45 may be regulated based on the control provided by the control unit 28. The main pipe 45 connects between the blower 44, the first pipe 46, the second pipe 52, and the pipe 32. Furthermore, the flow regulating valves 38, 48, and 54 are disposed at the connection between the main pipe 45 and the pipe 32, at the connection between the main pipe 45 and the first pipe 46, and at the connection between the main pipe 45 and the second pipe 52, respectively.

The air supply unit 22 allows the air supplied from the blower 44 to be blown off from the blowoff outlet 50 of the first pipe 46 through the main pipe 45 and the flow regulating valve 48 as well as allows the air to be blown off from the blowoff outlet 56 of the second pipe 52 through the main pipe 45 and the flow regulating valve 54. This allows the air to be supplied downstream of a position to which the fuel is supplied in the direction of flow of the combustion air. Furthermore, the air supply unit 22 controls the flow regulating valves 48 and 54 based on the control provided by the control unit 28, thereby regulating the amount of air supplied from the blowoff outlets 50 and 56 into the combustion furnace 12. Note that in the present invention, the air supplied from the main pipe 45 to the burner 30 through the flow regulating valve 38 is assumed to be primary air, while the air supplied from the main pipe 45 to the blowoff outlet 50 and the blowoff outlet 56 through the flow regulating valve 48 and the flow regulating valve 54 is assumed to be secondary air.

The air supply unit 22 supplies air into the combustion furnace 12, thereby accelerating combustion of fuel. As shown in FIG. 3, inside the combustion furnace 12, there are formed a burner combustion zone, an unburned fuel existing reduction zone, and a completed combustion zone from upstream to downstream in the direction of flow of the combustion air. Here, the burner combustion zone allows the burner 30 to inject powdered coal and air therein and burn the powdered coal and ranges from the most upstream (the position at which combustion is started) to a position upstream of the location of the blowoff outlet 50 in the direction of flow of the combustion air. The unburned fuel existing reduction zone allows the blowoff outlet 50 and the blowoff outlet 56 to supply air thereto, and the unreacted fuel and the air supplied from the blowoff outlet 50 and the blowoff outlet 56 to react each other. This zone ranges, in the direction of flow of the combustion air, from the location of the blowoff outlet 50 to the location of the blowoff outlet 56, that is, the zone covers an area into which the secondary air is supplied. On the other hand, the completed combustion zone allows the remaining fuel and air to react, and ranges, in the direction of flow of the combustion air, from a position downstream of the location of the blowoff outlet 56 to the connection between the combustion furnace 12 and the flue 14.

The concentration measuring unit 24 has a guide pipe 60, a suction pump 62, and a $H_2S$ measuring unit 64, and measures the concentration of $H_2S$ (hydrogen sulfide) in the combustion air at a measurement position inside the combustion furnace 12. The concentration measuring unit 24 sends to the control unit 28 information on the measured concentration of hydrogen sulfide in the combustion air.

The guide pipe 60 is a pipe-shaped member that is inserted into the combustion furnace 12 and has an end which is disposed inside the combustion furnace 12 and opened at a measurement position. Furthermore, in the present embodiment, the guide pipe 60 is disposed at a position downstream of the burner 30 and upstream of the blowoff outlet 50 in the direction of travel (flow) of the combustion air. That is, one end of the guide pipe 60 is disposed in the burner combustion zone. The suction pump 62 is a pump that can draw in air from inside the guide pipe 60 by suction. When the suction pump 62 draws in air from inside the guide pipe 60 by suction, the air around the end of the guide pipe 60 disposed inside the combustion furnace 12 is allowed to be sucked into the guide pipe 60. That is, the air at the measurement position is allowed to flow (can be guided) into the guide pipe 60.

Figure 4:
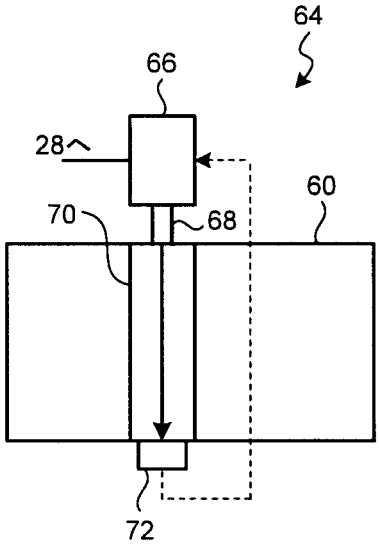
FIG. 4 is a block diagram illustrating a general configuration of a measuring unit shown in FIG. 1.

A description will now be made to the $H_2S$ measuring unit 64. Here, FIG. 4 is a block diagram illustrating a general configuration of the measuring unit shown in FIG. 1. The $H_2S$ measuring unit 64 is disposed in the guide pipe 60 to measure the concentration of hydrogen sulfide in the combustion air flowing through the guide pipe 60. As shown in FIG. 4, the $H_2S$ measuring unit 64 has a measuring unit main body 66, a light-emitting section 68, a measurement cell 70, and a light-receiving section 72.

The measuring unit main body 66 has a control function for laser beams emitted by the light-emitting section 68 and a computing function for calculating the concentration of hydrogen sulfide from a laser beam signal received by the light-receiving section 72. The light-emitting section 68 is a light-emitting mechanism for emitting laser beams in a wavelength band that is absorbed by hydrogen sulfide (more specifically, laser beams in a near-infrared band). The light-emitting section 68 directs the laser beams to the measurement cell 70 which is disposed in the guide pipe 60.

The measurement cell 70, which is disposed in part of the guide pipe 60, has an incidence portion for allowing beams of light emitted from the light-emitting section 68 to be incident on and enter the measurement cell 70 and an output portion for outputting the laser beam having passed through a predetermined path of the measurement cell 70. That is, the measurement cell 70 has a cylindrical structure that is disposed in place of part of the cylindrical portion of the guide pipe 60, where the incidence portion and the output portion are formed in part of the cylindrical structure. Note that the measurement cell 70 may also be configured to include only the incidence portion and the output portion in the guide pipe 60. That is to say, the measurement cell 70 can be configured to have only the incidence portion which allows the laser beam to be incident onto and enter the guide pipe 60 (an incidence window that transmits the laser beam) and the output portion which outputs the laser beam having passed through a predetermined path in the guide pipe 60 (an output window that transmits the laser beam).

Note that the measurement cell may be a pipe-shaped member which has the incidence portion and the output portion and communicates with the guide pipe 60. In this case, the measurement cell 70 allows part of the incidence portion and part of the output portion to be each connected to the guide pipe 60. As such, the measurement cell 70 is disposed in the guide pipe 60 so as to form part of the guide pipe of the combustion air. That is, part of the guide pipe 60 serves as the measurement cell 70. Note that when the measurement cell 70 is a pipe-shaped member that communicates with the guide pipe 60, it is necessary to provide a plurality of openings or holes to allow the combustion air to flow through the pipe-shaped member. Furthermore, the pipe-shaped member may also be provided with a slit that extends from the incidence portion toward the output portion. Note that the measurement cell 70 may have a pipe shape that has only to pass laser beams therethrough, and thus can be a pipe which is circular, polygonal, or elliptical in cross section. Furthermore, the measurement cell 70 may be a pipe with different inner and outer circumference shapes in cross section. Furthermore, in the example shown in FIG. 4, the measurement cell 70 was disposed to be orthogonal to the direction of flow of the combustion air in the guide pipe 60. However, the measurement cell 70 may also be tilted at a predetermined angle (i.e., diagonally) relative to the guide pipe 60.

The light-receiving section 72 receives the laser beam that has passed through the measurement cell 70 and output from the output portion and then outputs the strength of the received laser beam to the measuring unit main body 66 as a received signal.

The $H_2S$ measuring unit 64 is configured as described above, so that the laser beam output from the light-emitting section 68 passes through a predetermined path in the measurement cell 70 to be then output from the output portion. At this time, when the combustion air in the measurement cell 70 contains hydrogen sulfide, the laser beam passing through the measurement cell 70 is absorbed. This affects the laser beam in a manner such that the output of the laser beam reaching the output portion will vary depending on the concentration of hydrogen sulfide in the combustion air. The light-receiving section 72 converts the laser beam output from the output portion into a received signal, which is then output to the measuring unit main body 66. The measuring unit main body 66 compares the strength of the laser beam output from the light-emitting section 68 with the strength that is calculated based on the received signal sent from the light-receiving section 72 to find the rate of reduction in strength, from which the concentration of hydrogen sulfide in the combustion air flowing through the measurement cell 70 is calculated. As such, the $H_2S$ measuring unit 64 employs the TDLAS (Tunable Diode Laser Absorption Spectroscopy) scheme to calculate and/or measure the concentration of hydrogen sulfide in the combustion air inside the measurement cell 70, i.e., in the combustion air at a measurement position inside the combustion furnace 12 based on the output strength of the laser beam and the received signal detected at the light-receiving section 72. Furthermore, the $H_2S$ measuring unit 64 of the present embodiment can continuously calculate and/or measure the concentration of hydrogen sulfide.

Note that only the incidence portion and the output portion of the measurement cell 70 may be formed of an optically transparent material or alternatively the entire measurement cell 70 (i.e., the entire circumference of the pipe portion of the guide pipe 60 which serves as the measurement cell 70) may be formed of an optically transparent material. Furthermore, the measurement cell 70 may be provided with at least two optical mirrors so that the laser beam directed from the incidence portion is reflected by the optical mirrors multiple times and then output from the output portion. The laser beam reflected multiple times in this manner can pass through more regions in the measurement cell 70. This diminishes the effects of the concentration distribution of the combustion air flowing through the measurement cell 70 (variations in the flow rate or the density of the combustion air or variations in concentration distribution in the combustion air), allowing the concentration to be detected with accuracy.

Next, the nitrogen oxide concentration measuring unit 26 has a guide pipe 80, a preprocessing section 82, a suction pump 84, and a $NO_X$ measuring unit 86, and measures the concentration of $NO_X$ (nitrogen oxide) in the combustion air at a measurement position inside the flue 14. The nitrogen oxide concentration measuring unit 26 sends information on the measured concentration of nitrogen oxide in the combustion air to the control unit 28.

The guide pipe 80 is a pipe-shaped member having been inserted into the flue 14 and has an end which is disposed in the flue 14 and opens at the measurement position. The preprocessing section 82 is a filter for removing dust particles or the like that are contained in the combustion air flowing through the guide pipe 80 and thus serves to capture dust particles in the combustion air and remove the dust particles from the combustion air. On the other hand, the suction pump 84 draws in the air from inside the guide pipe 80 by suction. By allowing the suction pump 84 to draw in the air from inside the guide pipe 80 by suction, the air at the measurement position in the flue 14 is drawn into the guide pipe 60 by suction. The $NO_X$ measuring unit 86 is disposed in the guide pipe 80 downstream of the preprocessing section 82 in the direction of flow of the combustion air to measure the $NO_X$ concentration of the combustion gas flowing through the guide pipe 80. Note that the $NO_X$ measuring unit 86 is configured in the same manner as the $H_2S$ measuring unit 64 mentioned above and measures the concentration of $NO_X$ in the combustion air by the same method. Note that the configuration of each portion will not be detailed here. Here, to measure the concentration of multiple types of nitrogen oxides as the $NO_X$ concentration, it is necessary to provide a light-emitting section and a light-receiving section for each nitrogen oxide to be measured. As for the laser beam, it is also necessary to employ a laser beam of a different wavelength for each substance to be measured.

The control unit 28 regulates the amount of air (primary air) supplied from the fuel supply unit 20 into the combustion furnace 12 and the amount of air (secondary air) supplied from the air supply unit 22 into the combustion furnace 12. The control unit 28 makes these adjustments based on the measurement result of the $H_2S$ concentration of the combustion air sent from the $H_2S$ measuring unit 64 of the concentration measuring unit 24 and the detection result of the $NO_X$ concentration of the combustion air sent from the $NO_X$ measuring unit 86 of the nitrogen oxide concentration measuring unit 26. Note that the control unit 28 may be allowed only to record the detection result of the $NO_X$ concentration of the combustion air sent from the $NO_X$ measuring unit 86 of the nitrogen oxide concentration measuring unit 26 and may not be allowed to change the control condition based on the $NO_X$ concentration.

The control unit 28 reduces the amount of air for fuel (powdered coal) during combustion to allow combustion to take place in an enhanced reduction atmosphere, thereby suppressing the generation of nitrogen oxide due to combustion. More specifically, the control unit 28 regulates the amount of the air, which is supplied to the combustion furnace 12, based on the concentration of nitrogen oxide contained in the combustion air flowing through the flue 14 and detected by the nitrogen oxide concentration measuring unit 26. Furthermore, since nitrogen oxide tends to occur in a high-temperature combustion atmosphere, the control unit 28 provides control so as to reduce the amount of primary air. More specifically, the amounts of primary air and secondary air are regulated so that combustion takes place under the condition of lean air (oxygen) in the burner combustion zone, and the amount of air increases from the unburned fuel existing reduction zone to the completed combustion zone. As such, in the burner combustion zone where high temperatures can cause nitrogen oxide to be readily generated, combustion takes place in an enhanced reduction atmosphere, while combustion (combustion reaction) occurs with the reduction atmosphere being less enhanced for lower-temperature zones. This allows the combustion air expelled from the combustion furnace 12 to be completely burnt with sufficiently supplied air while suppressing the generation of nitrogen oxide.

On the other hand, hydrogen sulfide may be generated when combustion takes place in an enhanced reduction atmosphere. However, the control unit 28 regulates the flow regulating valves 38, 48, and 54 based on the hydrogen sulfide concentration detected by the concentration measuring unit 24, and controls the amount of primary air and the amount of secondary air, that is, the ratio of the primary air and the secondary air, e.g., by PID control. More specifically, the control unit 28 reduces the amount of primary air when the hydrogen sulfide concentration is less than a predetermined value. On the other hand, the control unit 28 increases the amount of primary air when the hydrogen sulfide concentration is higher than the predetermined value.

Figure 5:
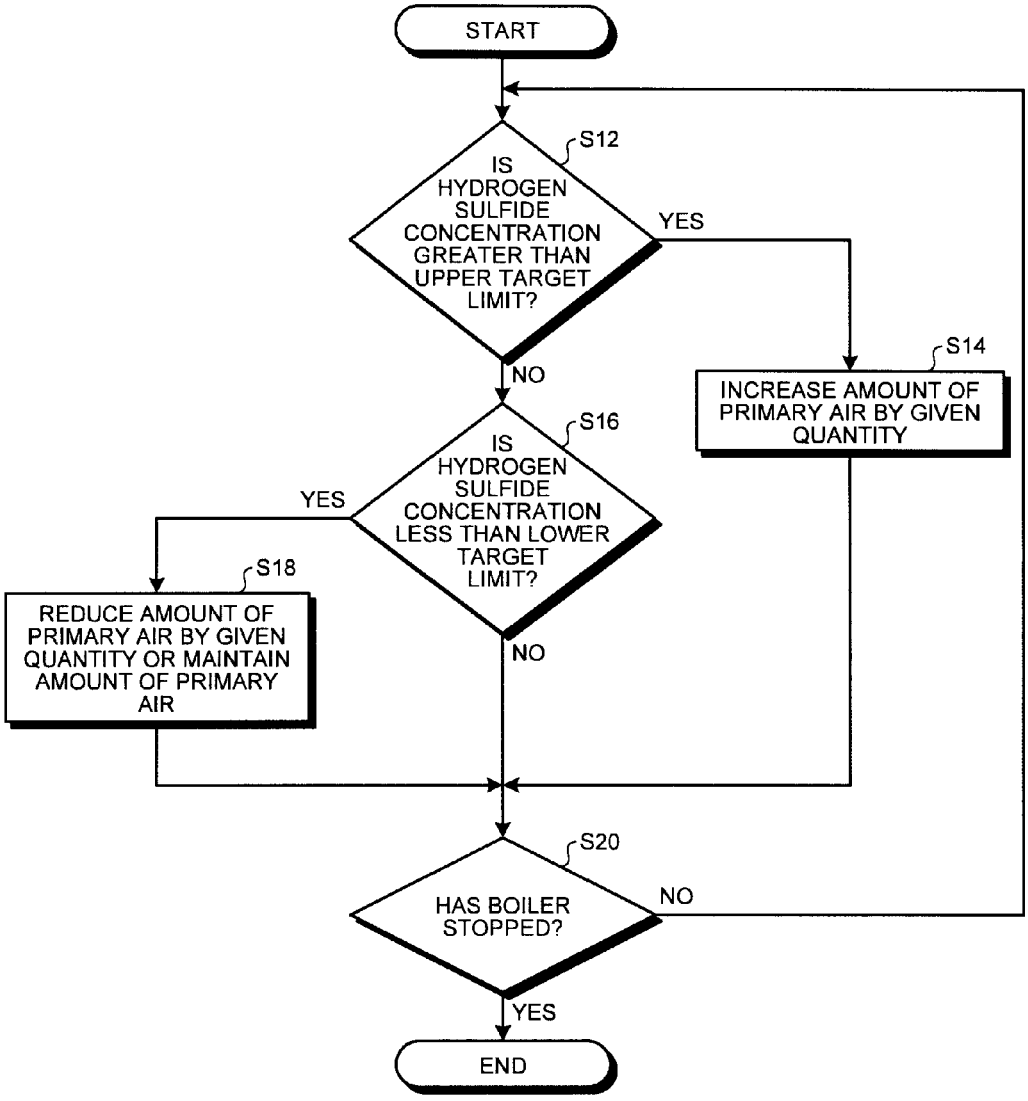
FIG. 5 is a flow diagram illustrating an example of a method for controlling the amount of supplied air by a control unit.

With reference to FIG. 5, a description will now be made to an example of the control. FIG. 5 is a flow diagram illustrating one example of a method for controlling the amount of supplied air by the control unit 28. First, when the hydrogen sulfide concentration measured by the concentration measuring unit 24 is entered to the control unit 28, the control unit 28 determines in step S12 whether the measured hydrogen sulfide concentration is greater than an upper target limit. If the hydrogen sulfide concentration measured in step S12 is determined to be greater than the upper target limit (Yes), the control unit 28 proceeds to step S14 to increase the currently specified amount of primary air (the amount of supplied primary air) by a certain quantity. That is, the amount of air injected from the burner 30 is increased by a certain quantity. Subsequently, the control unit 28 proceeds to step S20.

On the other hand, if it is determined in step S12 that the measured hydrogen sulfide concentration is equal to or less than the upper target limit (No), then the control unit 28 proceeds to step S16 to determine whether the measured hydrogen sulfide concentration is less than a lower target limit. If it is determined in step S16 that the measured hydrogen sulfide concentration is less than the lower target limit (Yes), then the control unit 28 proceeds to step S18 to reduce the currently specified amount of primary air (the amount of supplied primary air) by a certain quantity or maintain the amount of primary air. That is, the amount of primary air injected from the burner 30 is decreased by a certain quantity or alternatively maintained at that amount with no change made thereto. Subsequently, the control unit 28 proceeds to step S20. On the other hand, if it is determined in step S16 that the measured hydrogen sulfide concentration is greater than or equal to the target value (No), then the control unit 28 proceeds to step S20.

The control unit 28 determines in step S20 whether the boiler is stopped (i.e., whether combustion is stopped). If it is determined in step S20 that the boiler has not stopped (No), then the control unit 28 proceeds to step S12 to repeat the aforementioned processes. On the other hand, if it is determined in step S20 that the boiler has stopped (Yes), the control unit 28 exits the process. In this manner, the control unit 28 controls the amount of air supplied to the combustion furnace 12. Note that the amount of air can be varied by controlling the flow regulating valves 38, 48, and 54, for example, by regulating the opening degree thereof.

Here, in the aforementioned embodiment, the amount of primary air is increased or decreased by a certain quantity, but may also be increased or decreased by a certain percentage, for example, 5%. Furthermore, the aforementioned control is provided so as to increase or decrease the amount of primary air by a certain quantity with the flow regulating valves. However, when the flow regulating valves are fully opened, that is, when all the air supplied from the main pipe 45 is supplied to the combustion furnace 12, the setting of the amount of air supplied from the blower 44 (the upper limit or the lower limit) may be changed. On the other hand, only the amount of primary air is controlled in the aforementioned embodiment. However, the amount of secondary air may also be controlled according to the amount of primary air. For example, it is also acceptable that the amount of secondary air is reduced according to an increase in the amount of primary air while a constant amount of air is being supplied to the combustion furnace 12. Note that the amount of air supplied to the combustion furnace 12 is preferably controlled according to the amount of powdered coal supplied from the fuel supply unit 20.

Furthermore, the upper and lower target limits of the concentration of hydrogen sulfide may be different from each other. That is, the upper target limit employed in step S12 and the lower target limit employed in step S16 can be different from each other. By making the upper and lower target limits of the concentration of hydrogen sulfide different from each other, the concentration of hydrogen sulfide which does not vary the amount of primary air can be allowed to fall within a certain range. Note that the upper and lower target limits of the hydrogen sulfide concentration may also be the same value. For example, the target values can be set to 50 ppm.

On the other hand, the control unit 28 may be configured such that the upper target limit and/or the lower target limit of the concentration of hydrogen sulfide at a measurement position may be varied depending on the running condition of the combustion furnace or made constant irrespective of the running condition. If the upper target limit and/or the lower target limit are varied depending on the running condition, the amount of primary air can be controlled according to an increase or decrease in the amount of hydrogen sulfide contained in combustion air. This allows the generation of hydrogen sulfide to be reduced more adequately and the concentration of hydrogen sulfide at a measurement position to be maintained at a value close to a target value. Note that the same holds true when with the upper target limit and/or the lower target limit kept constant, the amount of primary air is controlled from the relationship between the upper target limit and/or the lower target limit and the running condition. On the other hand, if the upper target limit and/or the lower target limit of the concentration of hydrogen sulfide are made constant irrespective of the running condition, the running condition does not need to be detected and the target values do not need to be calculated according to the condition, thereby providing control in a simplified fashion. Alternatively, the concentration of hydrogen sulfide can also be controlled so as to be less than a setting irrespective of the condition.

The combustion controller 18 is configured basically as described above. The combustion controller 18 measures the concentration of hydrogen sulfide of the combustion air in the combustion furnace to regulate the amount of primary air based on the measurement result. This can suppress the generation of hydrogen sulfide even when combustion takes place in an enhanced reduction atmosphere. The generation of hydrogen sulfide is suppressed in this manner. This makes it possible to prevent each portion, for example, the boiler tube constituting the reheater or the wall surface of the combustion furnace, disposed inside the combustion furnace 12, from being corroded by hydrogen sulfide. The system can thus be operated for an extended period of time. Furthermore, since combustion takes place in an enhanced reduction atmosphere while suppressing the generation of hydrogen sulfide, the generation of nitrogen oxide can be suppressed as well.

Furthermore, since the sulfur component contained in fuel (coal or oil) varies depending on the fuel, even controlling the amount of primary air based on a pre-created map would cause the primary air to become excessively rich or lean. But, the hydrogen sulfide concentration of the combustion air can be measured, thereby controlling the amount of primary air in a more adequate manner. For example, since hydrogen sulfide is generated less likely for coal (powdered coal) which contains less sulfur component, a less amount of hydrogen sulfide is generated in a more enhanced reduction atmosphere, that is, even in the presence of a reduced amount of primary air. In contrast, since hydrogen sulfide tends to be generated more likely for coal (powdered coal) which contains more sulfur component, a greater amount of hydrogen sulfide is generated in the same reduction atmosphere. For this reason, when control is provided based on a pre-set condition map, the amount of primary air is difficult to vary according to such a variation in the condition, leading to an increase in the number of steps or an increase in the costs of the system. However, the present embodiment enables combustion in an adequate reduction atmosphere, while suppressing the generation of hydrogen sulfide, by making measurements without detecting the properties of the fuel. Furthermore, since the amount of primary air can be calculated based on the measurement results which have been obtained by actual measurements, the calculation can be simplified.

Furthermore, the $H_2S$ measuring unit employs a near-infrared laser beam to measure the concentration of hydrogen sulfide by TDLAS method, thereby allowing the concentration of hydrogen sulfide being measured to be measured accurately and continuously in a short period of time. Since the concentration of hydrogen sulfide can be accurately calculated, the amount of primary air can be adjusted accurately so as to reduce hydrogen sulfide in a more preferable manner. Furthermore, employing the near-infrared wavelength band beam as the laser beam allows the gas being measured to be measured with improved accuracy. That is, any gas other than the hydrogen sulfide to be measured can be prevented from being measured, thus allowing the concentration of hydrogen sulfide in the combustion air to be measured accurately in a short period of time. Note that the present embodiment has employed the near-infrared laser beam because only the target gas can be measured accurately. However, any laser beam other than those in the near-infrared wavelength band can be used as well.

Furthermore, since measurements can be made continuously in a short time, responsivity to a variation in combustion conditions can be enhanced, thereby further ensuring that hydrogen chloride which may be generated in the combustion air can be reduced.

Here, the concentration measuring unit 24 may make measurements at any position in the travel route of the combustion air inside the combustion furnace 12. The measured result of the concentration of hydrogen sulfide of the combustion air provided at any position can be based to provide control, thereby suppressing the generation of hydrogen sulfide. However, the unburned fuel existing reduction zone may be preferably employed as the measurement position, and the burner combustion zone may be more preferably employed as the measurement position. Measuring the hydrogen sulfide concentration in the unburned fuel existing reduction zone or the burner fuel zone, where hydrogen sulfide is more likely generated within the combustion furnace 12, allows for providing control so as to maintain the hydrogen sulfide concentration of that zone at a predetermined value or less. This in turn makes it possible to suppress the generation of hydrogen sulfide within the combustion furnace 12 and thus reduce areas where hydrogen sulfide exists. Furthermore, the measurement position is preferably disposed downstream of the burner and upstream of the repeater in the direction of travel of combustion air. By providing in this manner the measurement position upstream of the reheater to hold the hydrogen sulfide concentration at the measurement position at a certain value or less, the reheater can be prevented from being corroded.

Figure 6A:
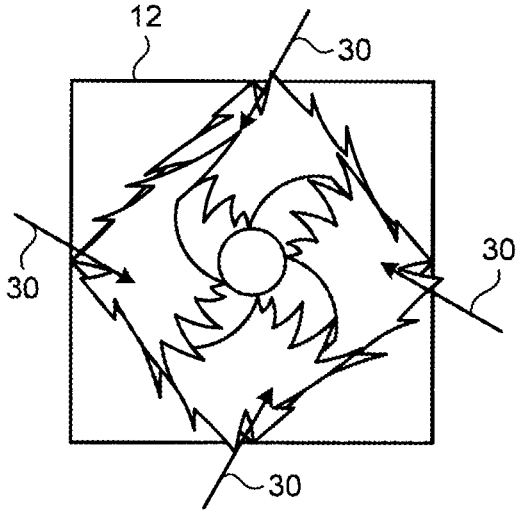
FIG. 6A is a cross-sectional view illustrating another arrangement example of a burner.
Figure 6B:
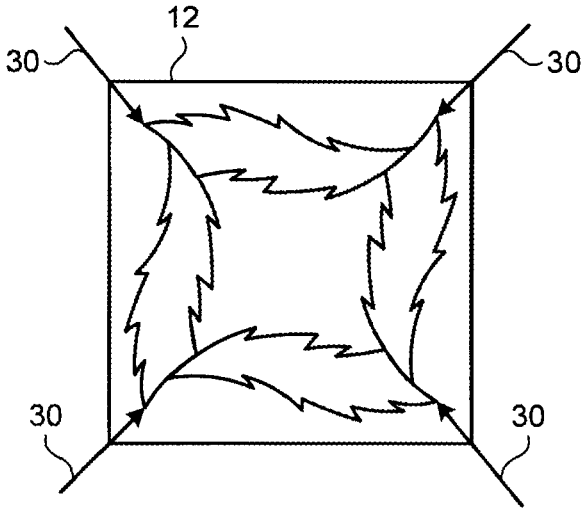
FIG. 6B is a cross-sectional view illustrating another arrangement example of the burner.

Here, the aforementioned embodiment has employed the four burners 30 disposed to allow expelled air to draw a circle. However, the present invention is not limited thereto. FIGS. 6A and 6B are each a cross-sectional view illustrating another arrangement example of the burners. For example, as shown in FIG. 6A, the burners 30 can also be tilted at a predetermined angle to wall surfaces of the combustion furnace 12. Furthermore, as shown in FIG. 6B, the burners 30 may be disposed at the corners of the combustion furnace 12 as well. Furthermore, the number of burners 30 is not limited to four but may be any. Furthermore, all the burners 30 are not necessarily disposed on the same plane, but may also be placed at different positions in the vertical direction, that is, the burners 30 may also be disposed at positions of different heights.

Figure 7:
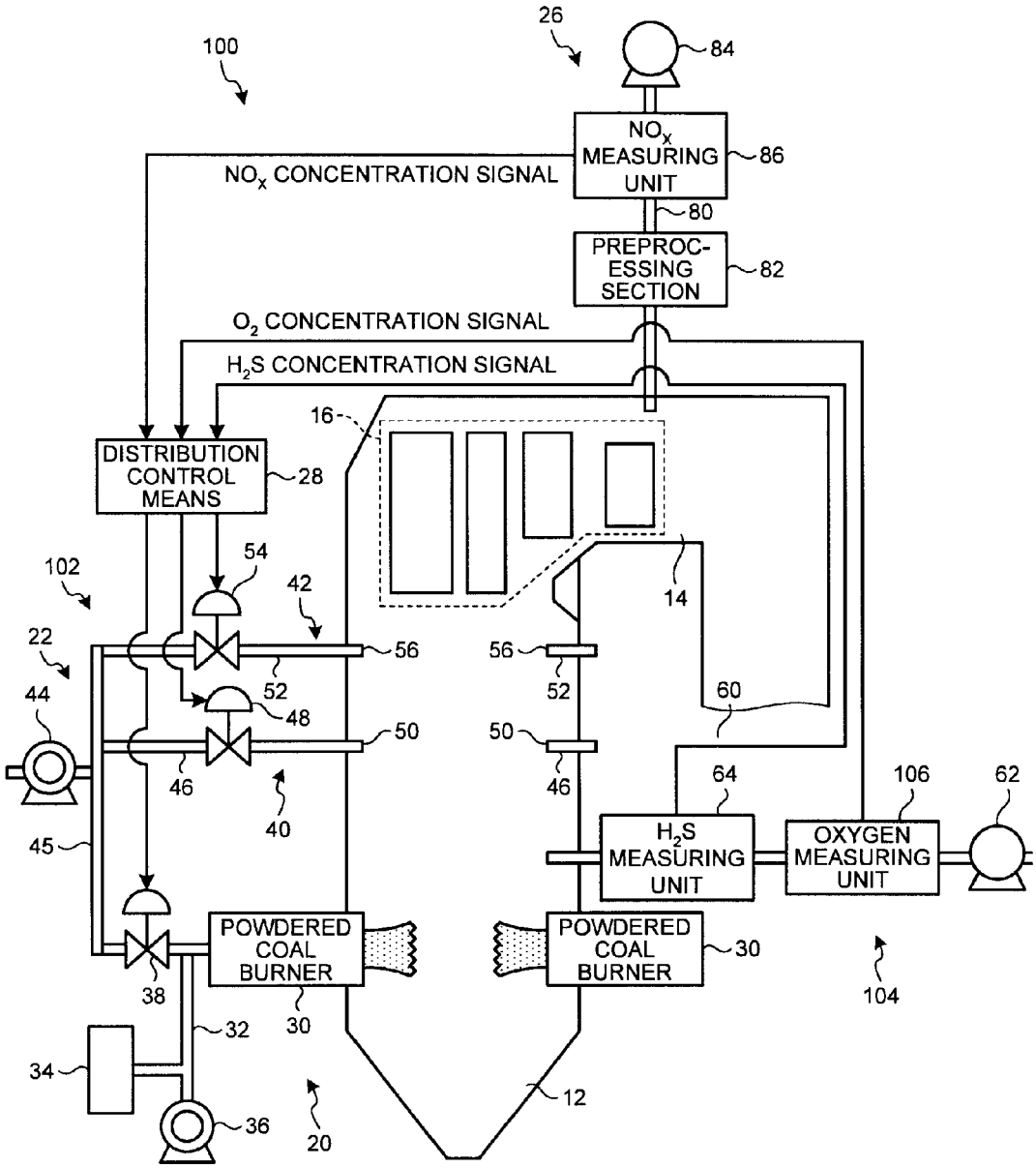
FIG. 7 is a block diagram illustrating a general configuration of a boiler of another embodiment which has a combustion controller of the present invention.

Furthermore, the combustion controller 18 is provided only with the $H_2S$ measuring unit 64 so as to control the amount of air supplied to the combustion furnace 12 based on the measurement results of the hydrogen sulfide concentration in the combustion air. However, the present invention is not limited thereto. With reference to FIG. 7, a description will next be made to another embodiment of the combustion controller of the present invention.

FIG. 7 is a block diagram illustrating a general configuration of a boiler of another embodiment which has the combustion controller of the present invention. Note that the boiler 100 shown in FIG. 7 is configured in the same manner as the boiler 10 shown in FIG. 1 except the configuration of a combustion controller 102, and accordingly, like components will not be repeatedly described but the points typical of the boiler 100 will be mainly described. The boiler 100 shown in FIG. 7 has the combustion furnace 12, the flue 14, the reheater unit 16, and the combustion controller 102. The combustion furnace 12, the flue 14, and the reheater unit 16 correspond to the respective portions of the boiler 10 shown in FIG. 1 and thus will not be described in more detail here.

The combustion controller 102 has the fuel supply unit 20, the air supply unit 22, concentration measuring unit 104, the nitrogen oxide concentration measuring unit 26, and the control unit 28. The fuel supply unit 20, the air supply unit 22, the nitrogen oxide concentration measuring unit 26, and the control unit 28 correspond to the respective portions of the combustion controller 18 shown in FIG. 1 and thus will not be described in more detail here. Furthermore, the concentration measuring unit 104 has the guide pipe 60, the suction pump 62, the $H_2S$ measuring unit 64, and an oxygen measuring unit 106 to measure the concentration of $H_2S$ (hydrogen sulfide) in combustion air and the concentration of $O_2$ (oxygen) at a measurement position inside the combustion furnace 12. The portions except the oxygen measuring unit 106 correspond to the respective portions of the concentration measuring unit 24 shown in FIG. 1 and thus will not be described in more detail here.

The oxygen measuring unit 106, configured in the same manner as the aforementioned $H_2S$ measuring unit 64, employs a like detection method to measure the concentration of oxygen ($O_2$ concentration) in the combustion air flowing through the guide pipe 60. The oxygen measuring unit sends the measured oxygen concentration signal to the control unit 28.

The control unit 28 regulates the amount of air (primary air) supplied from the fuel supply unit 20 to the combustion furnace 12 and the amount of air (secondary air) supplied from the air supply unit 22 to the combustion furnace 12. This regulation is carried out based on the measurement result on the $H_2S$ concentration of the combustion air sent from the $H_2S$ measuring unit 64 of the concentration measuring unit 104 as well as the measurement result on the oxygen concentration of the combustion air sent from the oxygen measuring unit 106. Note that the detection result on the $NO_X$ concentration of the combustion air sent from the $NO_X$ measuring unit 86 may or may not be taken into account for providing control in the same manner as above.

More specifically, as shown in FIG. 5, the control unit 28 provides control based on the hydrogen sulfide concentration and regulates the amount of supplied secondary air so that the oxygen concentration is equal to or greater than a target value (for example, an oxygen concentration of 2.8%) or falls within a target range. That is, the amount of supplied secondary air is increased when the oxygen concentration is less than the lower limit, whereas the amount of supplied secondary air is decreased when the oxygen concentration is higher than the upper limit.

As such, by measuring the oxygen concentration at a position for measurement of the concentration of hydrogen sulfide, the oxygen concentration at the measurement position can be maintained at a predetermined value or within a predetermined range. This allows the oxygen concentration in the combustion furnace 12 to be kept at a certain level or greater, so that combustion takes place without misfire. Furthermore, the oxygen concentration can be maintained at a certain value or less to maintain a predetermined reduction atmosphere.

Furthermore, the oxygen measuring unit 106 employs the same measuring method as that for the $H_2S$ measuring unit 64, thereby providing the same effects as those mentioned above that concentrations can be measured accurately in a short period of time.

Furthermore, in the aforementioned embodiment, the oxygen measuring unit is configured to measure the oxygen concentration at the position for measurement of the hydrogen sulfide concentration. However, the carbon monoxide (CO) concentration may also be measured instead of the oxygen concentration. In this case, the carbon monoxide concentration may be measured by the same method as that mentioned above. Furthermore, the control unit 28 decreases the amount of supplied secondary air when the carbon monoxide concentration is less than a lower limit, whereas increasing the amount of supplied secondary air when the carbon monoxide concentration is higher than an upper limit. Furthermore, the control unit may preferably place priority on providing control to make the concentration of hydrogen sulfide less than or equal to an upper target limit. That is, even when the oxygen concentration and the carbon monoxide concentration are out of a predetermined range, priority is preferably placed on providing control to make the hydrogen sulfide concentration less than or equal to the upper target limit.

Note that in the aforementioned embodiment, the concentrations of combustion air acquired at the same measurement position were measured because the system can be simplified and more adequate control can be provided, and each substance may also be measured at different positions.

Figure 8:
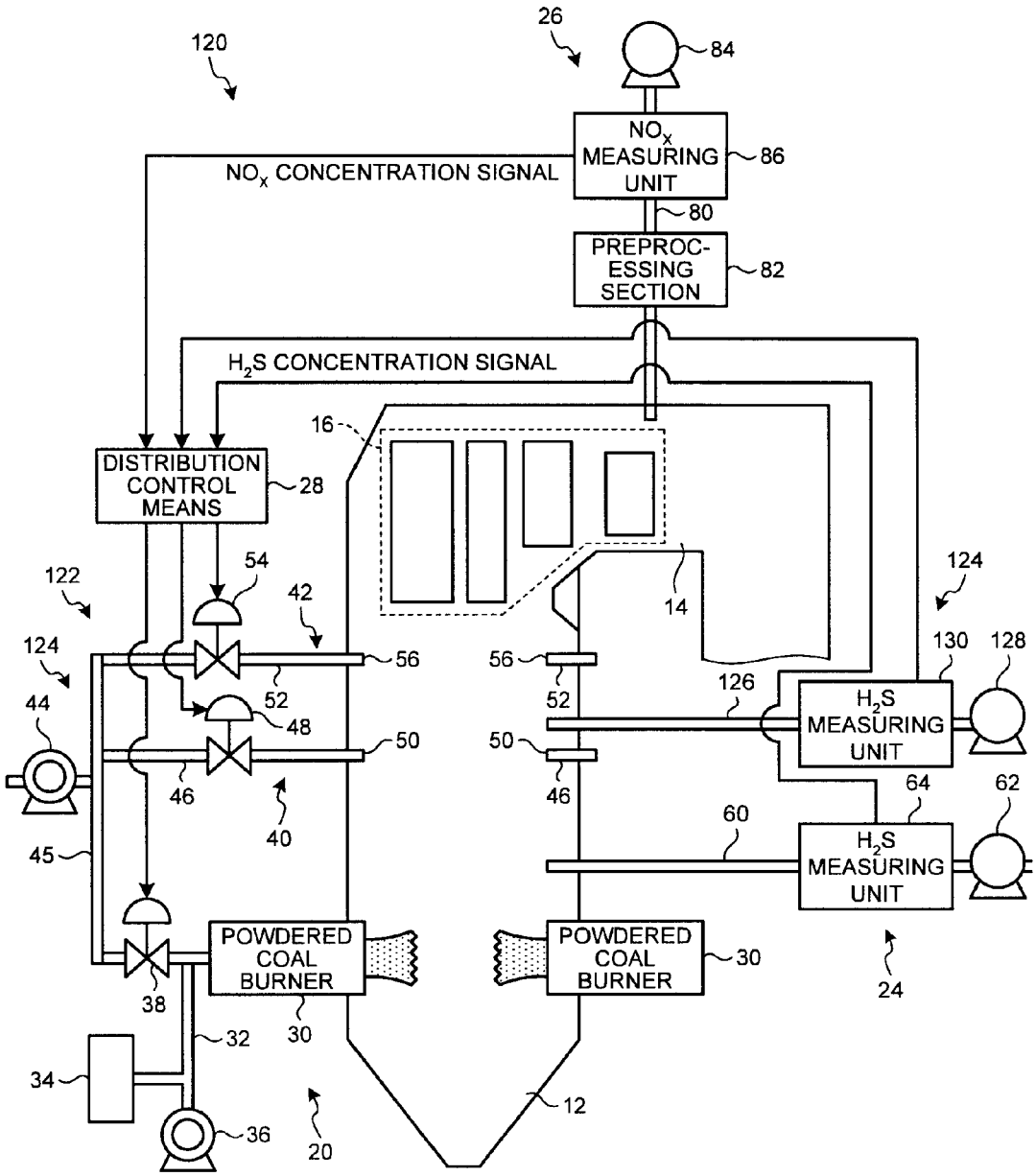
FIG. 8 is a block diagram illustrating a general configuration of a boiler of another embodiment which has a combustion controller of the present invention.

Furthermore, the combustion controller is preferably provided with a plurality of units for measuring the concentration of hydrogen sulfide in the combustion furnace 12. With reference to FIG. 8, a description will now be made to another embodiment of the combustion controller of the present invention. FIG. 8 is a block diagram illustrating a general configuration of a boiler of another embodiment which has the combustion controller of the present invention. Note that the boiler 120 shown in FIG. 8 is configured in the same manner as the boiler 10 shown in FIG. 1 except for the configuration of a combustion controller 122. Thus, like components will not be repeatedly described but the points typical of the boiler 120 will be mainly described below. The boiler 120 shown in FIG. 8 has the combustion furnace 12, the flue 14, the reheater unit 16, and the combustion controller 122. The combustion furnace 12, the flue 14, and the reheater unit 16 correspond to the respective portions of the boiler 10 shown in FIG. 1 and thus will not be described in more detail here.

The combustion controller 122 has the fuel supply unit 20, the air supply unit 22, the concentration measuring unit (which is implemented as "first concentration measuring unit" in this embodiment) 24, the nitrogen oxide concentration measuring unit 26, the control unit 28, and second concentration measuring unit 124. The fuel supply unit 20, the air supply unit 22, the concentration measuring unit 24, the nitrogen oxide concentration measuring unit 26, and the control unit 28 correspond to the respective portions of the combustion controller 18 shown in FIG. 1 and thus will not be described in more detail here.

The second concentration measuring unit 124 has a guide pipe 126, a suction pump 128, and a $H_2S$ measuring unit 130, and measures the concentration of $H_2S$ (hydrogen sulfide) of combustion air at a measurement position different from the measurement position for the concentration measuring unit 24 in the combustion furnace 12. Note that the second concentration measuring unit 124 and the (first) concentration measuring unit 24 are configured in the same manner except that the unit 124 and 24 are disposed at different positions. The second concentration measuring unit 124 has an opening at an end of the guide pipe 126 disposed between the blowoff outlet 50 and the blowoff outlet 56 in the travel route of combustion air, i.e., in the unburned fuel existing reduction zone, to measure the concentration of hydrogen sulfide of the combustion air in the unburned fuel reduction zone.

The control unit 28 controls the amounts of primary air and secondary air based on the hydrogen sulfide concentration measured by the concentration measuring unit 24 at a measurement position in the burner fuel zone and the hydrogen sulfide concentration measured by the second concentration measuring unit 124 at a measurement position in the unburned fuel existing reduction zone.

The amount of supplied air is controlled in this manner based on detection results obtained at a plurality of different positions in the travel route of the combustion air. This further ensures that the generation of hydrogen sulfide is suppressed and the reduction atmosphere in each zone is also controlled more adequately. Furthermore, although measurements are made at two positions in the aforementioned embodiment, the number of measurement positions can be increased to improve the accuracy of measurement and thereby provide finer control.

Here, in the aforementioned embodiment, as described in relation to regulating the amounts of primary air and secondary air, flow control may be preferably provided for each flow control valve or if possible, for each blowoff outlet. That is, in the present embodiment, the amount of secondary air can be controlled by regulating the opening degree of each of the flow regulating valve 48 and the flow regulating valve 54.

This makes it possible to control to which area in the unburned fuel existing reduction zone, the area closer to the burner combustion zone or the area closer to the completed combustion zone, a greater amount of the air is to be supplied. As such, finer control can be provided to the condition of each zone in the combustion furnace, creating an adequate reduction atmosphere and suppressing the generation of nitrogen oxide while suppressing the generation of hydrogen sulfide. Note that the control unit may preferably make an adjustment in a manner such that the amount of air (oxygen) increases from upstream (the burner side) toward downstream (the flue side) in the direction of travel of the combustion air. This makes it possible to gradually attenuate the reduction atmosphere, allowing combustion to take place while suppressing the generation of hydrogen sulfide and nitrogen oxide.

Figure 9:
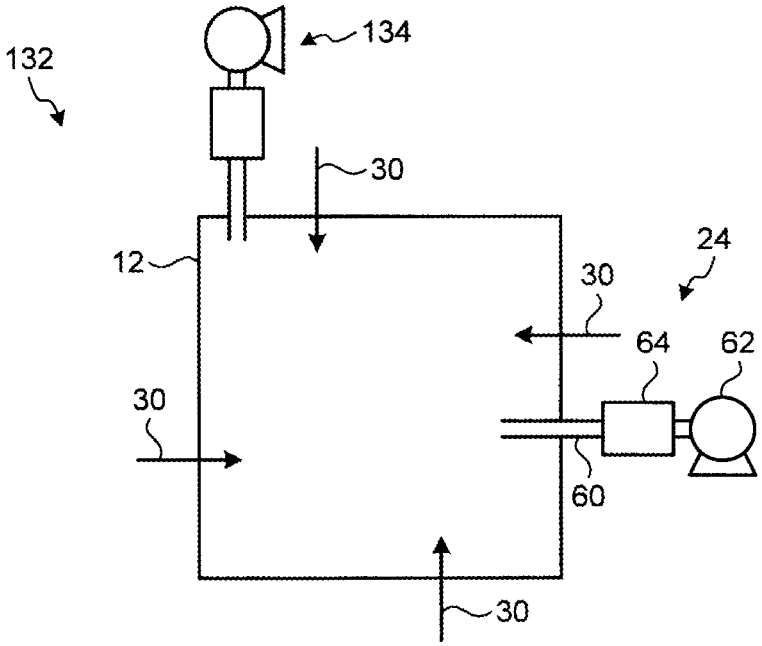
FIG. 9 is a cross-sectional view illustrating another arrangement example of a concentration measuring unit.

Furthermore, for use with the boiler like the present embodiment, a large amount of combustion air is produced thus increasing the opening area of the combustion furnace. Accordingly, it is preferable to measure the concentration of hydrogen sulfide at a plurality of points in the zone which can be regarded as located at the same position in the travel route of the combustion air (in the present embodiment, the points are located at the same vertical position but at different horizontal positions). With reference to FIG. 9, a description will next be made to an example. Here, FIG. 9 is a cross-sectional view illustrating another arrangement example of the concentration measuring unit. FIG. 9 shows a combustion controller 132 which has the concentration measuring unit 24 and second concentration measuring unit 134.

The second concentration measuring unit 134, which has the same configuration as the concentration measuring unit 24, measures the concentration of hydrogen sulfide at a measurement position which is located on the same cross-section plane as that for the concentration measuring unit 24 but at a measurement position different from that of the concentration measuring unit 24 on the cross section. Note that in this case, the control unit 28 calculates the highest concentration, the lowest concentration, and the average concentration from the concentrations measured at two points, and employs the calculated concentration as the concentration at the measurement position in the travel route of combustion air to provide control. Note that the method for calculating the concentration of hydrogen sulfide from measurement results at the plurality of points is not limited to a particular one, and the distribution of concentrations may be calculated from the measurement results to determine the overall concentration of hydrogen sulfide.

In this manner, the concentration of hydrogen sulfide is measured at the plurality of points in the zone that can be regarded as the same position in the travel route of combustion air. This allows for measuring the concentration of hydrogen sulfide in the combustion air with improved accuracy and thus providing more adequate control to the air to be supplied, even when the concentration of hydrogen sulfide is biased depending on the position inside the combustion chamber, for example, when the concentration is different between the center and an end portion.

Note that when concentrations are measured at a plurality of points as shown in FIGS. 8 and 9, the concentrations of a plurality of types of substances may also be measured at the respective points. For example, measurements may be made on the combination of hydrogen sulfide and carbon monoxide, hydrogen sulfide and oxygen, or hydrogen sulfide and nitric oxide to be described below.

Figure 10:
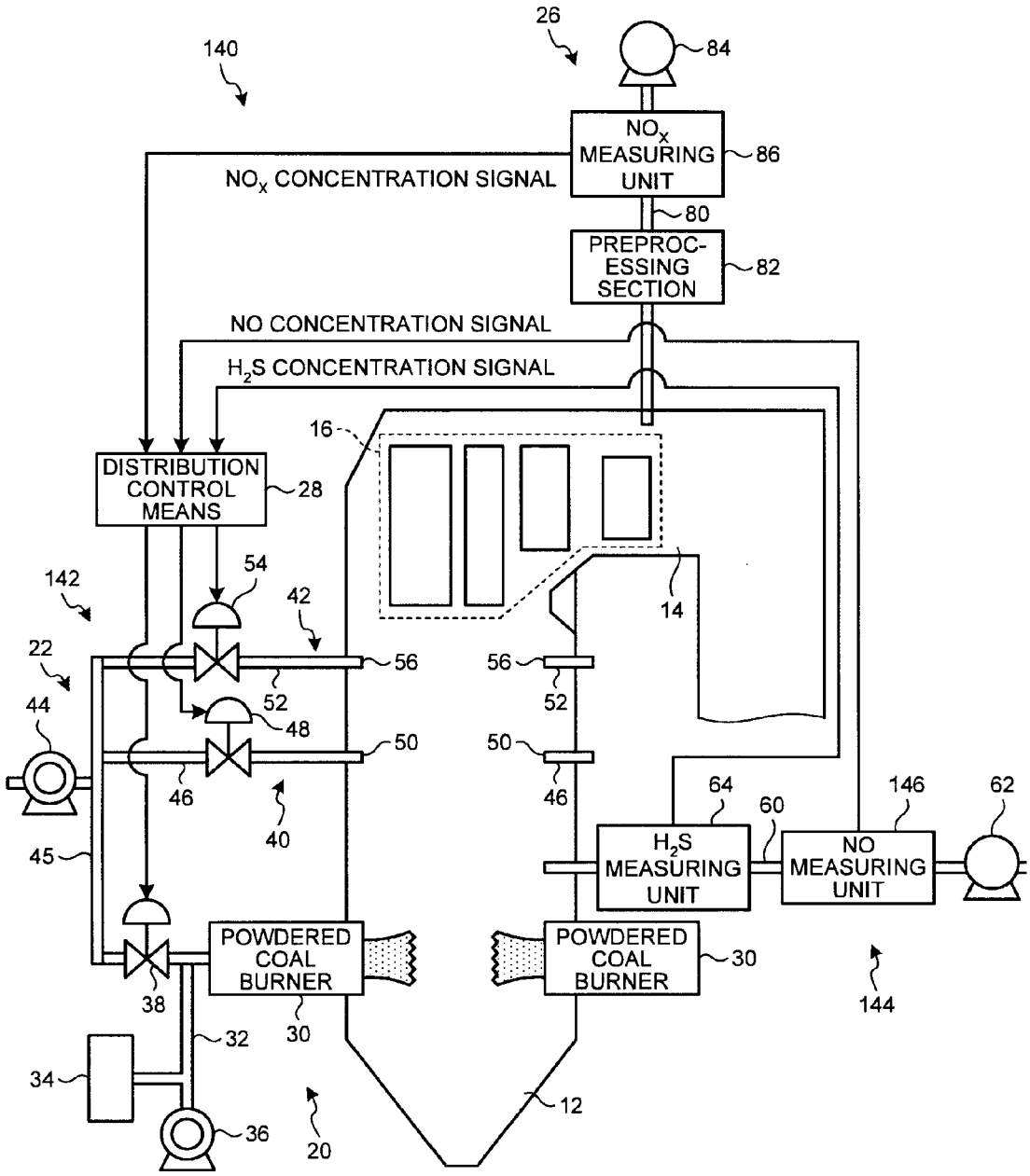
FIG. 10 is a block diagram illustrating a general configuration of a boiler of another embodiment which has a combustion controller of the present invention.

Furthermore, the combustion controller may also be configured to measure the concentrations of hydrogen sulfide and nitric oxide at a measurement position and then provide control based on the measurement results. With reference to FIG. 10, a description will next be made to another embodiment of the combustion controller of the present invention.

FIG. 10 is a block diagram illustrating a general configuration of a boiler of another embodiment which has the combustion controller of the present invention. Note that the boiler 140 shown in FIG. 10 is configured in the same manner as the boiler 10 shown in FIG. 1 except for the configuration of a combustion controller 142. Thus, like components will not be repeatedly described but the points typical of the boiler 140 will be mainly described. The boiler 140 shown in FIG. 10 has the combustion furnace 12, the flue 14, the reheater unit 16, and the combustion controller 142. The combustion furnace 12, the flue 14, and the reheater unit 16 correspond to the respective portions of the boiler 10 shown in FIG. 1 and thus will not be described in more detail here.

The combustion controller 142 has the fuel supply unit 20, the air supply unit 22, a concentration measuring unit 144, the nitrogen oxide concentration measuring unit 26, and the control unit 28. The fuel supply unit 20, the air supply unit 22, the nitrogen oxide concentration measuring unit 26, and the control unit 28 correspond to the respective portions of the combustion controller 18 shown in FIG. 1 and thus will not be described in more detail here. Furthermore, the concentration measuring unit 144 has the guide pipe 60, the suction pump 62, the $H_2S$ measuring unit 64, and an NO measuring unit 146, and measures the concentrations of $H_2S$ (hydrogen sulfide) and NO (nitric oxide) of the combustion air at a measurement position inside the combustion furnace 12. The portions other than the NO measuring unit 146 correspond to the respective portions of the concentration measuring unit 24 shown in FIG. 1 and thus will not be described in more detail here.

The NO measuring unit 146 is configured in the same manner as the N2S measuring unit 64 mentioned above and measures the nitric oxide concentration (NO concentration) of the combustion air flowing through the guide pipe 60 by a like detection method. The NO measuring unit 146 sends the measured oxygen concentration signal to the control unit 28.

The control unit 28 regulates the amount of air (primary air) supplied from the fuel supply unit 20 to the combustion furnace 12 and the amount of air (secondary air) supplied from the air supply unit 22 to the combustion furnace 12. The regulation is made based on not only the measurement result on the $H_2S$ concentration of the combustion air sent from the $H_2S$ measuring unit 64 of the concentration measuring unit 144 but also the measurement result on the oxygen concentration of the combustion air sent from the NO measuring unit 146. Note that as in the foregoing, control may or may not be provided by taking into account the detection result on the $NO_X$ concentration of the combustion air sent from the $NO_X$ measuring unit 86.

Figure 11:
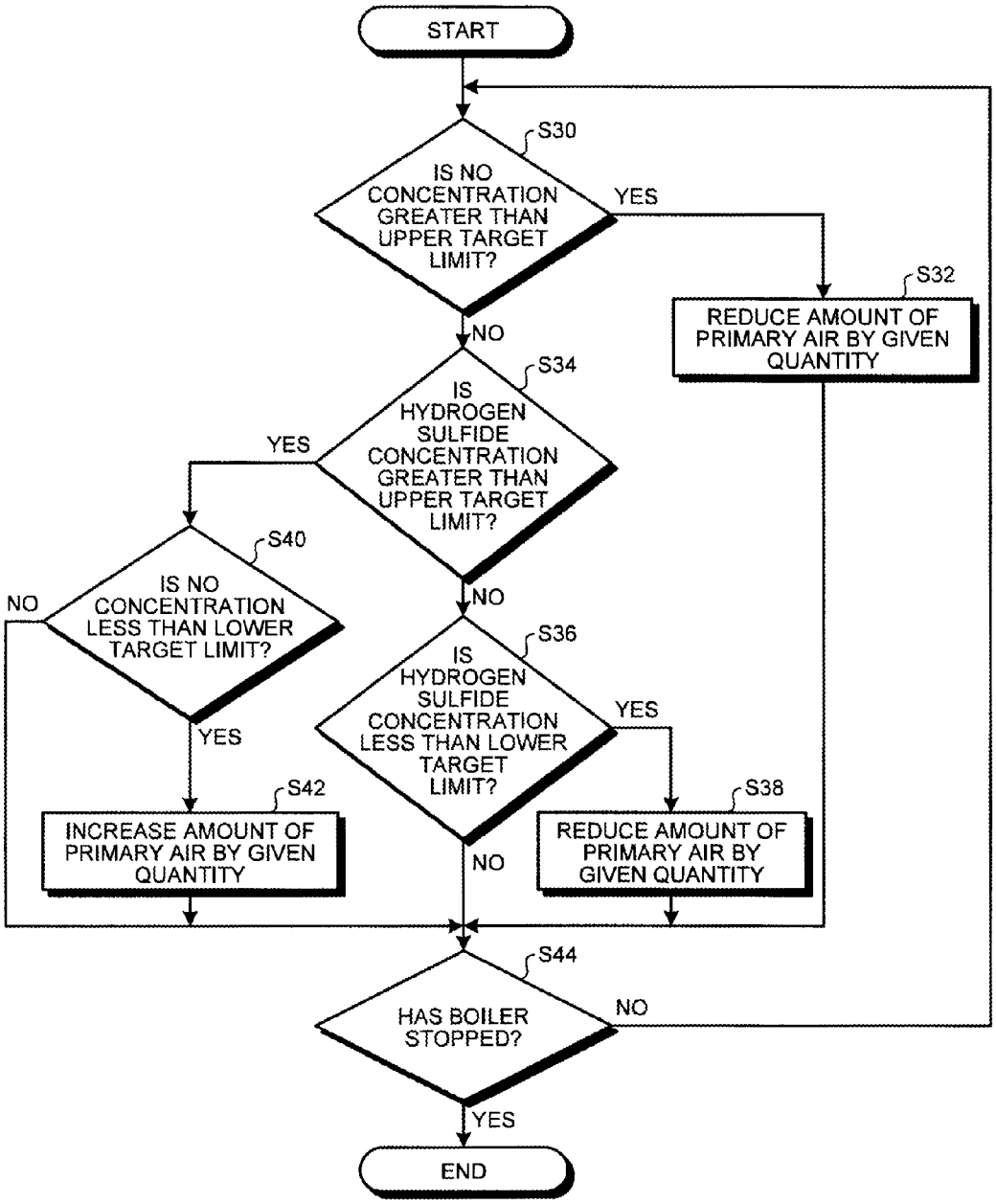
FIG. 11 is a flow diagram illustrating an example of a method for controlling the amount of supplied air by a control unit.

With reference to FIG. 11, a description will next be made to an example of control by the control unit 28. Here, FIG. 11 is a flow diagram illustrating an example of a method for controlling the amount of supplied air by the control unit. First, when the concentration of NO (nitric oxide) measured by the NO measuring unit 146 and the concentration of hydrogen sulfide measured by the concentration measuring unit 144 are entered to the control unit 28, the control unit 28 determines in step S30 whether the measured NO concentration is greater than an upper target limit.

If it is determined in step S30 that the measured NO concentration is greater than the upper target limit (Yes), then the control unit 28 proceeds to step S32 to reduce the currently specified amount of primary air (the amount of supplied primary air) by a certain quantity. That is, the amount of air injected from the burner 30 is decreased by a certain quantity. Subsequently, the control unit 28 proceeds to step S44.

Furthermore, if it is determined in step S30 that the measured NO concentration is equal to or less than the upper target limit (No), then the control unit 28 proceeds to step S34 to determine whether the measured hydrogen sulfide concentration is greater than an upper target limit.

Furthermore, if it is determined in step S34 that the measured hydrogen sulfide concentration is equal to or less than an upper target limit (No), then the control unit 28 proceeds to step S36 to determine whether the measured hydrogen sulfide concentration is less than a lower target limit. If it is determined in step S36 that the measured hydrogen sulfide concentration is less than the lower target limit (Yes), then the control unit 28 proceeds to step S38 to reduce the currently specified amount of primary air (the amount of supplied primary air) by a certain quantity, that is, to decrease the amount of primary air injected from the burner 30 by a certain quantity. Subsequently, the control unit 28 proceeds to step S44. On the other hand, if it is determined in step S36 that the measured hydrogen sulfide concentration is greater than or equal to the lower target limit (No), then the control unit 28 proceeds to step S44.

On the other hand, if it is determined in step S34 that the measured hydrogen sulfide concentration is greater than the upper target limit (Yes), then the control unit 28 determines in step S40 whether the measured NO concentration is less than a lower target limit. If it is determined in step S40 that the NO concentration is less than the lower target limit (Yes), then the control unit 28 proceeds to step S42 to increase the currently specified amount of primary air (the amount of supplied primary air) by a certain quantity. That is, the amount of air injected from the burner 30 is increased by a certain quantity. Subsequently, the control unit 28 proceeds to step S44. On the other hand, if it is determined in step S40 that the measured NO concentration is greater than or equal to the lower target limit (No), then the control unit 28 proceeds to step S44.

The control unit 28 determines in step S44 whether the boiler has stopped (that is, combustion is stopped). If it is determined in step S44 that the boiler has not stopped (No), then the control unit 28 proceeds to step S30 to repeat the aforementioned processes. On the other hand, if it is determined in step S44 that the boiler has stopped (Yes), then the control unit 28 exits the process. In this manner, the control unit 28 controls the amount of air supplied to the combustion furnace 12. Note that the amount of air can be varied by controlling the flow regulating valves 38, 48, and 54, for example, by regulating the opening degree thereof.

As described above, the combustion controller 142 detects the nitrogen sulfide concentration and the nitric oxide concentration at a measurement position, and provides control based on the detection results, thereby allowing the nitric oxide concentration at the measurement position to be maintained at a predetermined value or in a predetermined range. It is thus possible to make the amount of nitric oxide inside the combustion furnace 12 less than or equal to a certain concentration, reducing the amount of nitrogen oxide.

Furthermore, as shown in the flow diagram of FIG. 11, a higher priority is placed on the control that is based on the measurement result of nitric oxide, that is, the amount of primary air is reduced irrespective of the amount of hydrogen sulfide when the concentration of nitric oxide is high. On the other hand, the amount of primary air is prevented from increasing when the concentration of nitric oxide is not less than or equal to the lower limit. This makes it possible to reduce the generation of hydrogen sulfide while allowing the quantity of nitrogen oxide generated to be maintained at a predetermined level or less.

Furthermore, the NO measuring unit 146 employs a measuring method similar to that employed by the $H_2S$ measuring unit 64 to provide the same effects as described above that concentrations can be measured accurately in a short period of time. Note that since NO tends to be generated readily at the measurement position in a reduction atmosphere and at a high temperature, nitric oxide may be preferably measured as in the present embodiment. However, nitrogen dioxide may be measured or a plurality of nitrogen oxides may also be measured.

Note that in the aforementioned embodiments, the TDLAS method is employed to measure concentrations because the substance to be measured can be selectively detected with accuracy in a short period of time. However, the present invention is not limited thereto. The present invention can employ a device which follows a measuring method for measuring concentrations by transmitting various types of beams of light, such as an optical analysis method or the FTIR method (infrared spectroscopy).

INDUSTRIAL APPLICABILITY

As described above, the combustion controller according to the present invention is advantageously employed to help a combustion furnace for burning substances to burn the substances appropriately, and in particular, is suitable for a controller for a combustion furnace which suppress the production of nitrogen oxide.

REFERENCE SIGNS LIST

10 boiler
12 combustion furnace
14 flue
16 reheater unit
18 combustion controller
20 fuel supply unit
22 air supply unit
24 concentration measuring unit
26 nitrogen oxide concentration measuring unit
28 control unit
30 burner
32 pipe
34 powdered coal supply section
36 blower
38, 48, 54 flow regulating valve
40 first air supplying unit
42 second air supplying unit
44 air blower
45 main pipe
46 first pipe
50, 56 blowoff outlet
52 second pipe
60 guide pipe
62 suction pump
64 measuring unit
66 HS measuring unit main body
68 light-emitting section
70 measurement cell
72 light-receiving section
80 guide pipe
82 preprocessing section
84 suction pump
86 $NO_X$ measuring unit

The invention claimed is:

1. A combustion controller for controlling fuel and air which are supplied into a combustion furnace for burning a substance, the combustion controller comprising:

a fuel supply unit for supplying fuel and air into the combustion furnace;

an air supply unit which is disposed downstream of the fuel supply unit in a direction of flow of combustion air and supply air into the combustion furnace;

a concentration measuring unit for measuring a concentration of hydrogen sulfide of the combustion air by passing a measurement beam of light through the combustion air at a measurement position downstream of the fuel supply unit in the direction of flow of the combustion air; and a control unit for controlling an amount of air to supply from the fuel supply unit based on a measurement result provided by the concentration measuring unit, wherein the measurement beam of light is a laser beam in a wavelength band that is absorbed by the hydrogen sulfide, and the concentration measuring unit includes:

a light-emitting element for emitting a laser beam, a light-receiving element for receiving a laser beam having emitted from the light-emitting element and having passed through the combustion air, and a computing unit for computing the concentration of hydrogen sulfide based on the beam of light emitted from the light-emitting element and the beam of light received by the light-receiving element.

2. The combustion controller according to claim 1, wherein the control unit increases the amount of air to supply from the fuel supply unit when the concentration of hydrogen sulfide at the measurement position is higher than a preset upper limit, and reduces the amount of air to supply from the fuel supply unit when the concentration of hydrogen sulfide at the measurement position is less than a preset lower limit.

3. The combustion controller according to claim 1, wherein the concentration measuring unit has a guide pipe for guiding air at the measurement position inside the combustion furnace, the light-emitting element irradiates combustion air flowing through the guide pipe with the laser beam, and the light-receiving element receives the laser beam having passed through the combustion air inside the guide pipe.

4. The combustion controller according to claim 1, further comprising an oxygen concentration measuring unit for measuring a concentration of oxygen of the combustion air by passing a measurement beam of light through the combustion air at the measurement position, wherein the control unit also takes into account a measurement result provided by the oxygen concentration measuring unit to control the amount of air to supply from the fuel supply unit and an amount of air to supply from the air supply unit.

5. The combustion controller according to claim 1, wherein a plurality of the concentration measuring units for measuring concentrations are provided and measure a concentration of hydrogen sulfide at a plurality of measurement positions located at different positions in the direction of flow of the combustion air, and the control unit controls the amount of air to supply from the fuel supply unit and the amount of air to supply from the air supply unit so that a concentration of hydrogen sulfide in air inside the combustion furnace is gradually reduced with an increased distance from the fuel supply unit in the direction of flow of the combustion air.

6. The combustion controller according to claim 1, wherein a plurality of the air supply units for supplying air into the combustion furnace are provided, and the control unit controls the amount of air to supply from the air supply unit so that the concentration of oxygen in the air inside the combustion furnace gradually increases with an increased distance from the fuel supply unit in the direction of flow of the combustion air.

7. The combustion controller according to claim 1, wherein the measurement position is downstream of the fuel supply unit in the direction of flow of the combustion air and upstream of a reheater disposed inside the incinerator.

8. The combustion controller according to claim 1, further comprising a nitrogen oxide concentration measuring unit for measuring a concentration of nitrogen oxide of the combustion air by passing a measurement beam of light through the combustion air at the measurement position, and wherein the control unit also takes into account a measurement result provided by the nitrogen oxide concentration measuring unit to control the amount of air to supply from the fuel supply unit and the amount of air to supply from the air supply unit.

9. The combustion controller according to claim 8, wherein when the measurement result provided by the nitrogen oxide concentration measuring unit is higher than a preset upper limit, the control unit decreases the amount of air supplied from the fuel supply unit irrespective of the concentration of hydrogen sulfide.

* * * * *